United States Patent [19]

Bennett

[11] 4,261,488

[45] Apr. 14, 1981

[54] POWDER ENTRAINING SQUEEZE CONTAINER

[76] Inventor: Robert A. Bennett, 170 Sturbridge Rd., Easton, Conn. 06425

[21] Appl. No.: 73,708

[22] Filed: Sep. 10, 1979

[51] Int. Cl.[3] ..... B65D 83/06

[52] U.S. Cl. ..... 222/633; 222/211; 222/214; 239/327

[58] Field of Search ..... 222/207, 209, 211, 214, 222/215, 454, 455, 457.5, 631, 632, 633; 239/318, 327, 350

[56] References Cited

U.S. PATENT DOCUMENTS

| | | | |
|---|---|---|---|
| 3,369,713 | 2/1968 | Godschalk, Jr. | 222/633 |
| 4,007,858 | 2/1977 | Shay | 222/633 |
| 4,015,753 | 4/1977 | Bennett | 222/209 X |
| 4,091,966 | 5/1978 | Laauwe | 222/211 |

FOREIGN PATENT DOCUMENTS

| | | | |
|---|---|---|---|
| 554133 | 1/1957 | Belgium | 239/327 |

*Primary Examiner*—Joseph J. Rolla
*Assistant Examiner*—Fred A. Silverberg

[57] ABSTRACT

A device for use in a powder entraining squeeze container employs a first vertical hollow circular conduit having a first diameter, open at top and bottom ends and constituting a dip tube. A hollow spherical chamber having a second and much larger diameter and constituting an air powder mixing chamber is disposed above the dip tube, the top end of the dip tube being connected to the bottom of the chamber. A second vertical hollow conduit having a third diameter smaller than the first diameter is secured at its open bottom end to the top of the chamber and is used to discharge the mixture from its top open end. A third vertical hollow conduit in the chamber wall is open at top and bottom ends and is disposed alongside of a portion of the first conduit. The diameter of the third conduit is substantially equal to the third diameter. The open top of a vertical hollow cup closed at its bottom is spaced below the chamber. The cup has a cylinder extending upward from the bottom of the cup to receive the bottom end of the first conduit, this cylinder having a bore which communicates with the interior of the first conduit. The cup bottom has an opening communicating with the bore.

7 Claims, 7 Drawing Figures

POWDER ENTRAINING SQUEEZE CONTAINER

BACKGROUND OF THE INVENTION

U.S. Pat. No. 4,015,753 discloses a powder entraining squeeze container wherein a vertical dip tube extends through the powder in the container almost to the bottom. As the container is squeezed, powder is forced upward within the tube while air is simultaneously forced upward along a vertical air tube disposed alongside the dip tube. The powder is discharged from the tube vertically upward into a spherical mixing chamber. At the same time, the air is discharged from the air tube into the chamber, the air entering the chamber along an upwardly inclined path. The resulting swirling action of air and powder within the chamber produces an essentially homogenous mixture of air and powder which is discharged vertically upward as fine spray through a vertical discharge conduit connected at its bottom end to the chamber.

The invention disclosed above functions very well for containers which when half full (the conventional depth of initial fill) contain up to four ounces of powder. However, when heavier weights of fill are employed, the spray deteriorates in quality, becoming less homogenous, and clogging can occur. The present invention overcomes this difficulty whereby heavier powder fills can be employed and yet a fine homogenous spray is produced without clogging.

SUMMARY OF THE INVENTION

In accordance with the present invention, powder and air are premixed in a cup disposed in the container and the resultant mixture is fed upwardly through a dip tube. As the mixture is forced upwardly, additional air is simultaneously forced upwardly along the outside of the dip tube. The mixture is discharged into a spherical mixing chamber. At the same time, the additional air is fed into the chamber at a separate location. A swirling action in the chamber ensues and additional air is added substantially homogenously to the original powder-air mixture. The homogenous mixture containing additional air is discharged vertically upward as a fine spray through a vertical discharge conduit connected at its bottom end to the chamber.

DETAILED DESCRIPTION OF PREFERRED EMBODIMENTS

Figure 1:
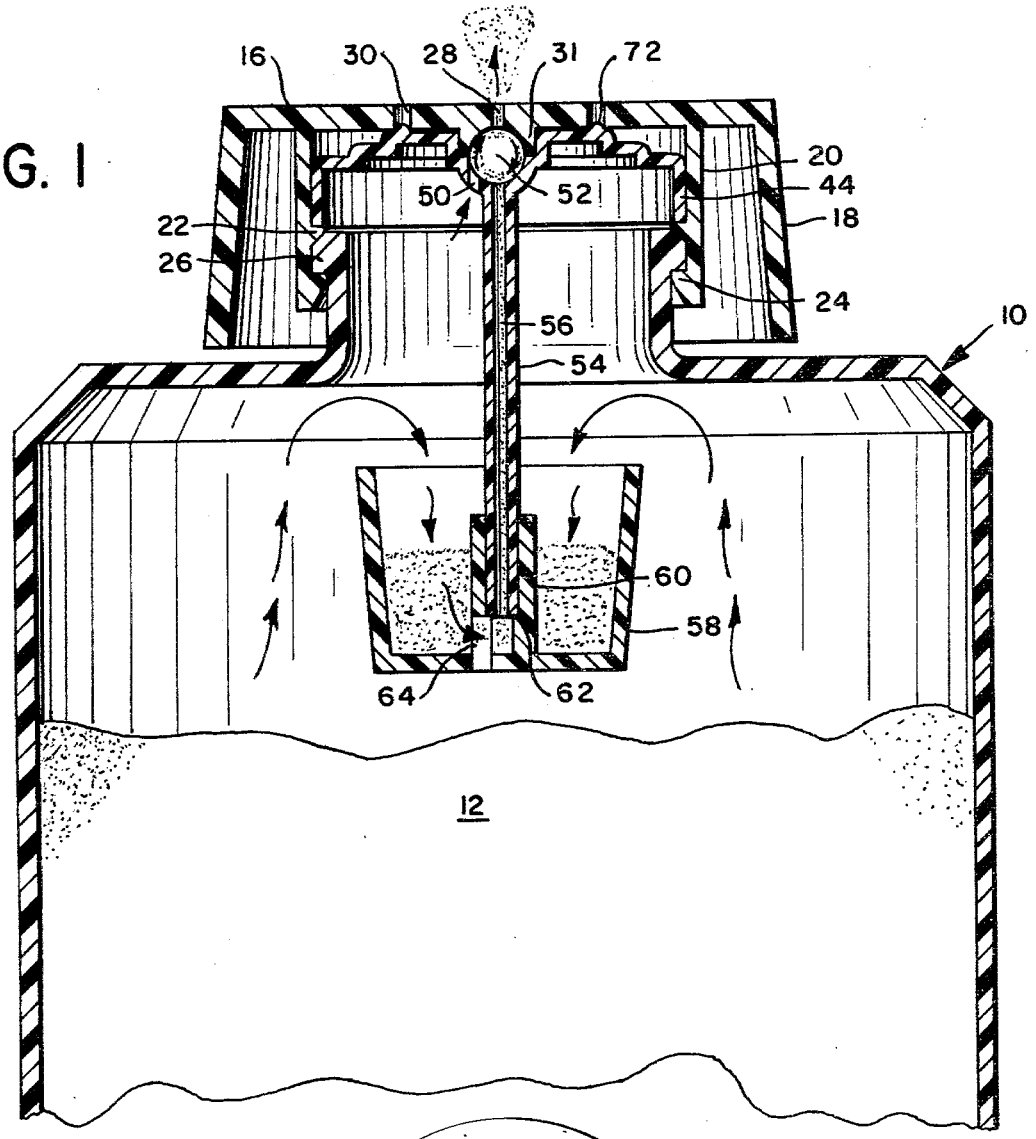
FIG. 1 is a vertical cross section of an embodiment of the invention in use.
Figure 2:
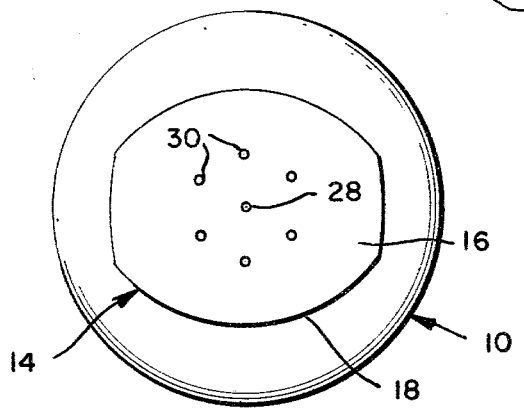
FIG. 2 is a top view of the structure of FIG. 1.
Figure 3:
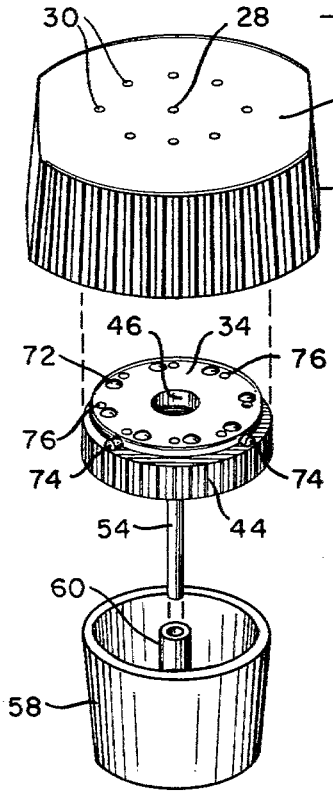
FIG. 3 is an exploded view showing in perspective the embodiment of the invention shown in FIG. 1.
Figure 4:
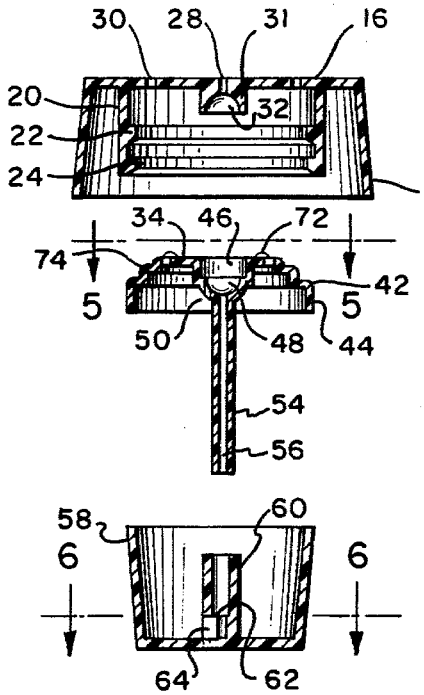
FIG. 4 is a view similar to FIG. 3 but shown in vertical cross section.
Figure 5:
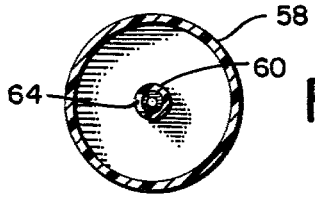
FIG. 5 is a view taken along 5—5 in FIG. 4.
Figure 7:
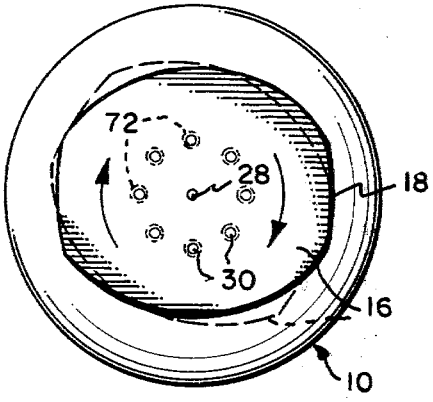
FIG. 7 is a top view of the structure of FIG. 1 illustrating the twisting action thereof.
Figure 6:
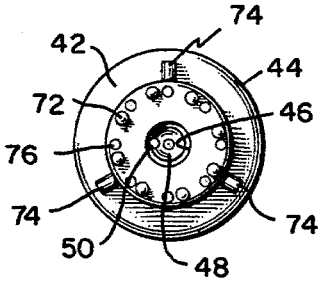
FIG. 6 is a view taken along 6—6 in FIG. 5.

Referring now to FIGS. 1-7, a hollow squeeze type container 10 is initially half filled with powder 12. A cover 14 has a flat horizontal top 16 and a downwardly extending outer peripheral flange 18. The cover has an inner circular peripheral flange 20 with upper and lower horizontal circular rings 22 and 24 disposed on the inner surface of the flange 20. Flange 20 engages the top open neck of the container with the outer peripheral lip 26 of the neck snap fitting between rings 22 and 24. Top 16 has a central bore 28 with outer bores 30 disposed in equally spaced positions along a circle centered on bore 28. This circle is spaced inwardly from the lip 26 and overlies the open portion of the neck of the container. The central section of the top 16 has a vertical downward extension which defines a cylinder 31. The bottom end of the cylinder defines an upper hollow hemisphere 32 of a sphere which communicates via bore 28 to the outside of top 16.

A hollow molded member has a top circular surface 34 with an integral bottom shoulder 36 defining a lower annular surface 38, surface 38 having an integral bottom shoulder 40 defining a still lower and larger diameter annular surface 42. Surface 42 has integral bottom shoulder 44. All of these shoulders define shallow vertical cylinders open at their bottom ends. A hollow vertical cylinder 46 open at the top end and terminating in a hollow convex bottom hemisphere 48 is centered in the member and extends downwardly through surfaces 34, 38 and 42. The wall of hemisphere 48 has a vertical conduit 50 therein offset from the vertical diameter of the hemisphere and open at top and bottom ends.

The member described above snap fits within flange 20 between ring 22 and top 16 with cylinder 31 fitting tightly within cylinder 46, whereby the upper and lower hemispheres meet in mating engagement to define a hollow spherical chamber 52.

Lower hemisphere 48 terminates in a vertically downward extending hollow dip tube 54. The tube 54 has a vertical bore 56 open at top and bottom ends, the top end of bore 56 communicating with the interior of chamber 52.

A vertical hollow cup 58 which actually defines a vertical conical section tapering inward and downward is open at the top and closed at the bottom. The bottom of cup 58 is disposed at a depth of about one fifth of the vertical distance (total depth) between the top of the neck and the bottom of the container. A vertical hollow cylinder 60 centered on the bottom of the cup extends upwardly therefrom. The inner diameter of cylinder 60 is set so that the bottom end of tube 54 can fit tightly therein. The cylinder 60 has a shoulder 62 which holds the bottom end of tube 54 above the bottom of the cup as a stop. A vertical bore 64 extends through the bottom of the cup into the wall of cylinder 60 to communicate with the interior of tube 54.

When the tube 54 is fitted within the cup, the top of the cup is spaced below the bottom of the neck of the container.

In operation, when the container is squeezed and released, powder is forced upward from the top surface of the powder fill and powder grains together with entrained air are collected in the cup. (It should be noted that as the container is released, air flows into the container via bore 28, chamber 52 and conduit 50).

This charges the cup with a powder-air mixture 66. When the container is again squeezed, a portion of this powder-air mixture is drawn upwardly within bore 56 into the interior of the chamber 52 because of the pressure drop created between the outside of conduit 50 and the bottom end of bore 64 while at the same time additional air in the container is forced upward through conduit 52. The additional air and the original powder air mixture in the chamber swirl around to produce the homogenous spray discharged through bore 28. At the same time, additional powder grains and entrained air are collected in the cup so that the cup always is charged with the mixture.

In the claims which follow, tube 54 is defined as a first vertical hollow conduit; bore 28 is defined as a second vertical hollow conduit; and conduit 50 is defined as third hollow conduit.

For reasons set forth in the aforesaid U.S. Pat. No. 4,015,753, the diameter of tube 54, the first diameter, is larger than the diameter of bore 28, the third diameter, and the third diameter of bore 28 is essentially equal to that of the conduit 50. The diameter of the sphere, the second diameter is substantially larger than that of bore 28.

All of the parts shown herein are typically formed of polypropylene.

The cup is slightly tapered to facilitate removal from a mold but could also have cylindrical shape. Typically, the cup inner diameter and depth can each be one inch and the thickness of the cup can be 0.05 inches.

The bottom surface of top 16 has shallow recesses 70 disposed along the same circle as bores 30, each recess being disposed adjacent a corresponding bore. Surface 34 has a like plurality of holes 72 disposed along a like circle and a like plurality of shallow bumps 76 disposed along the same circle, each bump being disposed adjacent a corresponding hole.

Normally, the cover is disposed so that each bump engages a recess and bores 30 are out of alignment with holes 72. Then no powder can escape except as a spray. However, when the cover is rotated to disengage bumps and recesses, holes and bores are aligned and the container can be shaken with the powder being discharged through the holes and bores.

Raised members 74 on surface 42 act as stops to limit the rotation of the cover to a selected arc.

What is claimed is:

1. A device for use in a powder entraining squeeze container having an open neck and partially filled with powder, said device comprising:

a first vertical hollow conduit having an open top end and a bottom end, said conduit having a circular cross section with a first diameter;

a hollow spherical chamber having a second diameter substantially larger than the first diameter and disposed above the first conduit; the top end of the first conduit being connected to and communicating with the bottom of the chamber;

a second vertical hollow conduit disposed above the chamber, said second conduit having a circular cross section with a third diameter smaller than said first diameter and open at top and bottom ends, the bottom end of the second conduit being connected to and communicating with the top of the chamber, the top end of the second conduit comprising a discharge port;

a third vertical hollow conduit in the chamber wall and open at top and bottom ends, said third conduit being disposed alongside of a portion of the first conduit, the third conduit having a circular cross section, the diameter of the third conduit being substantially equal to the third diameter; and a hollow vertical cup open at the top and closed at the bottom by a bottom wall the top of the cup being spaced below the chamber, the said cup having means extending upward from the bottom of the cup to receive the bottom end of the first conduit, said bottom wall of the cup having an opening communicating with the interior of said first hollow conduit and the interior of the container, said cup, when said device is disposed in the container, being spaced below the neck and above the powder.

2. The device of claim 1 further including a cover which partially defines said chamber and contains said second conduit.

3. The device of claim 2 further including a member having a central recess which together with said cover completely defines said chamber, said member containing said third conduit.

4. The device of claim 3 further including said container, the member, first, second and third conduits and said cup being disposed in the container, said cover resting upon and rotatably engaging the top of the neck.

5. The device of claim 9 wherein said member is disposed non rotatably in the container.

6. The device of claim 3 wherein said cover has a centrally disposed downwardly extending vertical cylinder having a concave recess in the lower end defining the upper hemisphere of said chamber.

7. The device of claim 6 wherein said member has a centrally disposed vertical cylindrical channel with a lower end defining a convex hollow lower hemisphere, said cylinder fitting rotatably into said channel to join the hemispheres in mating engagement to form said chamber.

* * * * *